US012221662B2

(12) United States Patent
Yang et al.

(10) Patent No.: US 12,221,662 B2
(45) Date of Patent: Feb. 11, 2025

(54) METHOD OF FORMING A DYNAMICALLY TRANSFORMABLE NANOTWINNED STRUCTURE IN AN AUSTENITE STEEL ALLOY

(71) Applicant: City University of Hong Kong, Hong Kong (HK)

(72) Inventors: Tao Yang, Hong Kong (HK); Qian Li, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 120 days.

(21) Appl. No.: 18/153,374

(22) Filed: Jan. 12, 2023

(65) Prior Publication Data

US 2024/0240277 A1 Jul. 18, 2024

(51) Int. Cl.
*C21D 8/02* (2006.01)
*C21D 9/00* (2006.01)

(52) U.S. Cl.
CPC ..... *C21D 8/0236* (2013.01); *C21D 8/0205* (2013.01); *C21D 8/0226* (2013.01); *C21D 8/0268* (2013.01); *C21D 8/0273* (2013.01); *C21D 9/0081* (2013.01); *C21D 2201/03* (2013.01); *C21D 2211/001* (2013.01); *C21D 2211/008* (2013.01)

(58) Field of Classification Search
None
See application file for complete search history.

(56) References Cited

PUBLICATIONS

J.M. Gere, B.J. Goodno, Mechanics of materials, Cengage learning 2012, Link: https://books.google.com.hk/books?id=WQfFDwAAQBAJ&lpg=PP1&ots=U2bhdzQBJn&dq=mechanics%20of%20materials&lr&hl=zh-CN&pg=PR4#v=onepage&q&f=false.

M.A. Meyers, K.K. Chawla, Mechanical behavior of materials, Cambridge university press 2008, Link: https://books.google.com.hk/books?hl=zh-CN&lr=&id=v-_oAwAAQBAJ&oi=fnd&pg=PT18&dq=Mechanical+behavior+of+materials&ots=KpsbDfcu8a&sig=8WL5zrqOkH_P6NEFPOfVTc-jkbU&redir_esc=y#v=onepage&q=Mechanical%20behavior%20of%20materials&f=false.

H. Gleiter, Nanostructured Materials: Basic Concepts and Microstructure, Acta mater. 48 (200) 1-29.

K. Lu, L. Lu, S. Suresh, Strengthening materials by engineering coherent internal boundaries at the nanoscale, Science 324 (2009) 349-352.

L. Lu, X. Chen, X. Huang, K. Lu, Revealing the maximum strength in nanotwinned copper, Science 323 (2009) 607-610.

Lu, Y.F. Shen, X.H. Chen, L.H. Qian, K. Lu, Ultrahigh strength and high electrical conductivity in copper, Science 304 (2004) 422-426.

(Continued)

*Primary Examiner* — Anthony M Liang
(74) *Attorney, Agent, or Firm* — Idea Intellectual Limited; Margaret A. Burke; Sam T. Yip

(57) ABSTRACT

A method of creating a ductile, work-hardened, nanotwinned, austenite/martensite nano-lamellar nanostructure in an austenite steel alloy. Briefly, raw materials with high-purity are smelted to obtain an as-cast steel alloy ingot, which will be subjected to homogenization and cold-roll treatment for reduction. The homogenized and cold-rolled steel alloy ingot is further recrystallized to eliminate any possible casting defects and form an as-recrystallized steel alloy having a single face-centered cubic structure with recrystallized grains. The as-recrystallized steel alloy is cold-rolled again for forming a nanotwinned austenite structure and for forming martensite lamellae along nanotwin boundaries such that an austenite/martensite nano-lamellar structure in the steel alloy.

15 Claims, 11 Drawing Sheets

(56) References Cited

PUBLICATIONS

Y. Shen, N. Jia, Y. Wang, X. Sun, L. Zuo, D. Raabe, Suppression of twinning and phase transformation in an ultrafine grained 2 GPa strong metastable austenitic steel: Experiment and simulation, Acta Mater. 97 (2015) 305-315.
H. Wu, G. Fan, An overview of tailoring strain delocalization for strength-ductility synergy, J Progress in Materials Science 113 (2020) 100675.
R.K. Nutor, Q. Cao, R. Wei, Q. Su, G. Du, X. Wang, F. Li, D. Zhang, J.-Z. Jiang, A dual-phase alloy with ultrahigh strength-ductility synergy over a wide temperature range, Sci. Adv. 7 (2021) eabi4404.
J. Gao, S. Jiang, H. Zhang, Y. Huang, D. Guan, Y. Xu, S. Guan, L.A. Bendersky, A.V. Davydov, Y. Wu, Facile route to pulk ultrafine-grain steels for high strength and ductility, Nature 590 (2021) 262-267.
R.O. Ritchie, The conflicts between strength and toughness, Nature Mater. 10 (2011) 817-822.
B. He, B. Hu, H. Yen, G. Cheng, Z. Wang, H. Luo, M. Huang, High dislocation density-induced large ductility in deformed and partitioned steels, Science 357 (2017) 1029-1032.
Y. Wei, Y. Li, L. Zhu, Y. Liu, X. Lei, G. Wang, Y. Wu, Z. Mi, J. Liu, H. Wang, H. Gao, Evading the strength-ductility trade-off dilemma in steel through gradient hierarchical nanotwins, Nat Commun 5 (2014) 3580.
Z. Budrovic, H. Van Swygenhoven, P.M. Derlet, S. Van Petegem, B. Schmitt, Plastic Deformation with Reversible Peak Broadening in Nanocrystalline Nickel, Science 304 (2004) 273-276.
E. Ma, X. Wu, Tailoring heterogeneities in high-entropy alloys to promote strength-ductility synergy, Nat. Commun. 10 (2019) 5623.
Z. You, X. Li, L. Gui, Q. Lu, T. Zhu, H. Gao, L. Lu, Plastic anisotropy and associated deformation mechanisms in hanotwinned metals, Acta Mater. 61 (2013) 217-227.
Z. Cheng, H. Zhou, Q. Lu, H. Gao, L. Lu, Extra strengthening and work hardening in gradient nanotwinned metals, Science 362 (2018).
G. Xiao, N. Tao, K. Lu, Strength-ductility combination of nanostructured Cu—Zn alloy with nanotwin bundles, Scr. Mater. 65 (2011) 119-122.
H. Wang, N. Tao, K. Lu, Strengthening an austenitic Fe—Mn steel using nanotwinned austenitic grains, Acta Mater. 60 (2012) 4027-4040.
F. Yan, G. Liu, N. Tao, K. Lu, Strength and ductility of 316L austenitic stainless steel strengthened by nano-scale twin bundles, Acta Mater. 60 (2012) 1059-1071.
H.Y. Yi, F.K. Yan, N.R. Tao, K. Lu, Comparison of strength-ductility combinations between nanotwinned austenite and martensite-austenite stainless steels, Mater. Sci. Eng. A 647 (2015) 152-156.
A. Chen, J. Liu, H. Wang, J. Lu, Y.M. Wang, Gradient twinned 304 stainless steels for high strength and high ductility, Mater. Sci. Eng. A 667 (2016) 179-188.
D. Raabe, D. Ponge, O. Dmitrieva, B. Sander, Nanoprecipitate-hardened 1.5 GPa steels with unexpected high ductility. Scr. Mater. 60 (2009) 1141-1144.
A. Arlazarov, O. Bouaziz, A. Hazotte, M. Goune, S. Allain, Characterization and modeling of manganese effect on strength and strain hardening of martensitic carbon steels, ISIJ international 53 (2013) 1076-1080.
S. Jiang, H. Wang, Y. Wu, X. Liu, H. Chen, M. Yao, B. Gault, D. Ponge, D. Raabe, A. Hirata, Ultrastrong steel via minimal lattice misfit and high-density nanoprecipitation, Nature 544 (2017) 460-464.
J.-I. Zhao, X. Yan, S. Wen, L. Lin, Microstructure and mechanical properties of high manganese TRIP steel, J. Iron Steel Res. Int. 19 (2012) 57-62.
M. Zhang, L. Li, R. Fu, D. Krizan, B. De Cooman, Continuous cooling transformation diagrams and properties of micro-alloyed TRIP steels, Mater. Sci. Eng. A 438 (2006) 296-299.
Y.-S. Jung, Y.-K. Lee, D.K. Matlock, M.C. Mataya, Effect of grain size on strain-induced martensitic transformation start temperature in an ultrafine grained metastable austenitic steel, Met. Mater. Int. 17 (2011) 553-556.
B. He, On the factors governing austenite stability: intrinsic versus extrinsic, Materials 13 (2020) 3440.
X.-S. Yang, S. Sun, H.-H. Ruan, S.-Q. Shi, T.-Y. Zhang, Shear and shuffling accomplishing polymorphic fcc $\gamma \rightarrow$ hcp $\varepsilon \rightarrow$ bct $\alpha$ martensitic phase transformation, Acta Mater. 136 (2017) 347-354.

METHOD OF FORMING A DYNAMICALLY TRANSFORMABLE NANOTWINNED STRUCTURE IN AN AUSTENITE STEEL ALLOY

FIELD OF THE INVENTION

The present invention generally relates to the field of steel alloys. More specifically, the present invention relates to a steel alloy with high strength and improved ductility.

BACKGROUND OF THE INVENTION

Steels have formed the backbone of the modern industry due to their advantageous mechanical properties and economic benefits. The improvement in the strength of steel promotes significant progress in technology. For example, the continuous improvement of steel cable strength has doubled the span of cable-stayed bridges. The production of high-strength steel has always been the key area of competition among steel industries. However, improving the strength always comes with a severe reduction in ductility. For conventional high-strength steels, when the yield strength exceeds 1 GPa, the uniform elongation will be limited, usually less than 10%. The poor ductility makes the forming process difficult, limiting the application of traditional high-strength steel.

Strength and ductility, representing the capability of materials to withstand an applied load without plastic deformation and to absorb overload, respectively, are the two key criteria for assessing the reliability of materials in engineering and manufacturing. Simultaneously, improving the strength and ductility of metallic materials is a long-standing pursuit for materials design, motivated by the progress in technology. Since the 1980s, considerable efforts have been devoted to strengthening alloys by refining grain sizes to the nanoscale to create a nanocrystalline alloy and successfully improving the strength by an order of magnitude. However, nanocrystalline alloys still have the problem of limited ductility, leading to poor uniform elongation. It also means that practical applications of nanocrystalline alloys remain elusive.

Nanotwins strengthening is known as a strategy to optimize the strength-ductility synergy due to the unique interaction between dislocation and twin boundaries; however, it has been unable to overcome the intrinsic conflict between strength and ductility, also known as the strength-ductility trade-off. The strength-ductility trade-off originates from the dislocation-dominated deformation mechanisms in metallic alloys. The introduced high density of crystalline defects may impede dislocations to enhance strength but also exhaust the capability of dislocation accumulation, diminishing the capability to work-harden the alloy. The twin boundary is believed to be a desirable structure for improving the ductility of nanostructured alloys due to its unique deformation mechanism; that is, it not only impedes dislocation motion but also accommodates dislocations slipping on the twin planes. Nevertheless, the ductility of nanotwinned metals is still far below that of their coarse-grained counterparts, following the strength-ductility trade-off inevitability; this is not surprising since plastic deformation of nanotwinned alloys is also dominated by the dislocation-boundary interactions. The capability of dislocation generation and accumulation is also limited when the twin thickness is refined into the nanoscale.

In order to overcome the obstacles related to the strength-ductility trade-off, there is a need for a deformation mechanism that can provide extra strain hardening in nanostructured alloys to delocalize strains. Therefore, the present invention addresses this need.

SUMMARY OF THE INVENTION

It is an objective of the present invention to provide a steel alloy that can evade the strength-ductility trade-off. Particularly, the steel alloy has a dynamically transformable nanotwinned (DT-NT) structure that not only impedes dislocation to strengthen the alloy but also dynamically transforms into a nano-laminated martensite/austenite dual-phase structure to elevate the work-hardening rate.

In accordance with a first aspect of the present invention, the method of creating a ductile, work-hardened, nanotwinned, austenite/martensite nano-lamellar nanostructure in an austenite steel alloy, including the following steps:

- smelting high-purity raw materials to obtain an as-cast steel alloy ingot;
- homogenizing the as-cast alloy ingot to obtain a homogenized austenite steel alloy ingot;
- cold-rolling the homogenized austenite steel alloy ingot at room temperature to a reduction of 40-60%;
- recrystallizing the cold-rolled austenite steel ingot to eliminate casting defects and form an as-recrystallized austenite (AR) steel having a single face-centered cubic structure with recrystallized grains; and
- cold-rolling the AR austenite steel alloy with a reduction of 40-80% for forming a dynamically transformable nanotwinned structure.

In accordance with one embodiment of the present invention, the DT-NT structure provides twin boundaries as a platform for impeding dislocations and partially transforming the austenite phase into a martensite phase to form a nano-laminated martensite/austenite dual-phase structure when the alloy is under a strain.

In accordance with one embodiment of the present invention, the method may further include low-temperature annealing process to facilitate dislocation recovery and relieve stress.

In accordance with one embodiment of the present invention, the temperature of recrystallization annealing is higher than an austenitizing temperature, which may be between 1000-1200° C.

In accordance with another embodiment of the present invention, a hot-roll or hot-forge treatment at a temperature higher than the austenitizing temperature may be further included.

In accordance with one embodiment of the present invention, the high-purity raw materials comprise 22-26 wt. % of Ni, 0.8-2.5 wt. % of Al, 0.8-2.5 wt. % of Si, 0.2-0.6 wt. % of C and 66.142-68.4 wt. % of Fe.

In accordance with another embodiment of the present invention, the high-purity raw materials comprise 22-25 wt. % of Ni, 0.8-3 wt. % of Si, 0.2-0.6 wt. % of C, and 71.4-77 wt. % of Fe.

In accordance with a second aspect of the present invention, a ductile chromium-free work-hardened nanostructured Fe—Ni—Al—Si—C steel alloy, which has a dynamic transformable nanotwinned structure, the martensite phase extending from nano-twinned regions and being present in an amount from approximately 6 volume percent to approximately 30 volume percent of the nanostructure, the martensite phase formed as martensite lamellae alternating with austenite lamellae. The nanotwinned austenite structure not only strengthens the alloy but also promotes martensite transformation to elevate work-hardening capability, thereby simultaneously improving the strength and ductility.

In accordance with another embodiment of the present invention, the ductile work-hardened Fe—Ni—Al—Si—C steel alloy has a yield strength of at least approximately 1.4 GPa with an elongation of at least approximately 40 percent In accordance with one embodiment of the present invention, the steel alloy is composed of 22-26 wt. % of Ni, 0.8-2.5 wt. % of Al, 0.8-2.5 wt. % of Si, 0.2-0.6 wt. % of C and 66.2-68.4 wt. % of Fe In accordance with another embodiment of the present invention, the steel alloy is composed of 22-25 wt. % of Ni, 0.8-3 wt. % of Si, 0.2-0.6 wt. % of C and 71.4-77 wt. % of Fe.

In accordance with a third aspect of the present invention, a safety component composed on an automobile made of the ductile work-hardened Fe—Ni—Al—Si—C steel alloy is provided.

In accordance with one embodiment of the present invention, the safety component includes front side members, floor side reinforcement, still inner, rear side member, B-pillar reinforcement, roof bow, and A-frame reinforcement.

In accordance with a fourth aspect of the present invention, a building material made of the ductile work-hardened Fe—Ni—Al—Si—C steel alloy is provided.

In accordance with one embodiment of the present invention, the building material includes a cable, a steel beam and a scaffold.

In accordance with a fifth aspect of the present invention, an aircraft material made of the ductile work-hardened Fe—Ni—Al—Si—C steel alloy is provided.

BRIEF DESCRIPTION OF THE DRAWINGS

Embodiments of the invention are described in more details hereinafter with reference to the drawings, in which:

FIG. 1A is electro backscatter diffraction orientation image, FIG. 1B is the phase map and FIG. 1C is X-ray pattern showing the single face-centered cubic phase recrystallized microstructure;

FIG. 2A depicts engineering stress-strain curves of the DT-NT steel, and the stress-strain curve of the AR steel with a uniaxial coarse-grained structure is also plotted for a direct comparison; FIG. 2B shows the tensile fractography of the DT-NT steel exhibiting the ductile dimpled structure; FIG. 2C shows the changes in yield strength versus changes in uniform elongation of the present DT-NT steel compared with various nanotwinned (NT) alloys, including NT Cu alloy, NT steel, and gradient-nanotwin alloy; and FIG. 2D shows the yield strength ($\sigma_y$) versus changes in uniform elongation ($\varepsilon_u$) of the DT-NT steel compared with high-strength steels, including the NT, martensite, and transformation-induced plasticity steels;

FIG. 3A is an electron backscatter diffraction orientation image showing nanotwin bundle embedded in the highly dislocated austenitic matrix; FIG. 3B is an electron backscatter diffraction phase map depicting a single face-centered cubic structure; FIG. 3C is an XRD pattern depicting a single face-centered cubic structure; FIG. 3D shows the nanotwin bundles observed in transmission electron microscopy (TEM) bright-field images with a zoomed-in image showing a selected-area diffraction pattern (SADP) confirming the twin structure; FIG. 3E is a high-resolution TEM image of the nanotwins; FIG. 3F shows the statistical distribution of the T/M lamellar thickness; FIG. 3G depicts atom maps reconstructed using 3D-APT to show the distribution of each element; FIG. 3H exhibits an one-dimensional composition profile that quantitatively reveals the elemental distribution through the tip;

FIG. 4A shows the true stress-strain curves of DT-NT and AR steel; FIG. 4B demonstrates the strain-hardening curves of DT-NT and AR steel; FIG. 4C is an EBSD orientation map showing the nanotwins in DT-NT steel with a true stress of 20%; FIG. 4D is a phase map showing the nanotwins in DT-NT steel alloy and AR alloys with a true stress of 20%; FIG. 4E is an EBSD orientation map showing the nanotwins in DT-NT and AR steels after fracture; FIG. 4F is a phase map showing the nanotwins in DT-NT and AR steels after fracture; FIG. 4G is a TEM bright-field image of the nanotwins in DT-NT steel at a true stress of 18%; FIG. 4H is a selected area diffraction pattern (SADP) confirming the presence of martensite in the nanotwins; and FIGS. 4I-4J showing are TEM dark-field images of twin/matrix lamellae and martensite, respectively, since the orientation between the martensite and austenite phase follows a double Nishiyama-Wasserman relationship;

FIG. 5A is an EBSD map of AR alloy before tension; FIG. 5B is an EBSD map of AR alloy after fracture; FIG. 5C is a bright-field TEM image of AR alloy at the strain of 5%; FIG. 5D is a bright-field TEM image of AR alloy at the strain of 20%; FIG. 5E is a bright-field TEM image of AR alloy after fracture; and FIG. 5F exhibits XRD patterns of AR alloy before and after tension showing that the volume fraction of martensite is around 7% in the post-tension AR alloy;

FIG. 6A is an XRD pattern showing that the DT-NT steel alloy still possesses a single fcc phase structure; FIG. 6B is a typical bright-field TEM image showing the dislocation structure of DT-NT steel; and FIG. 6C is a typical bright-field TEM image showing the nanotwins structure of DT-NT steel;

FIG. 8A is a bright-field TEM image of dislocation regions at a strain of 20%; and FIG. 8B is a bright-field TEM image of dislocation regions after fracture;

FIG. 10A is a high-resolution TEM image showing martensite phase nucleate at the twin boundary; FIG. 10B shows a magnified TEM image of the twin boundary showing that half-Shockley partial dislocation dipoles gliding on the twin plane lead to the martensite transformation at the upper area and a schematic diagram illustrating the martensite transformation in nano twins at the under area; and FIG. 10C is a schematic diagram showing the deformation mechanism of the DT-NT steel.

DETAILED DESCRIPTION

Figure 1A:
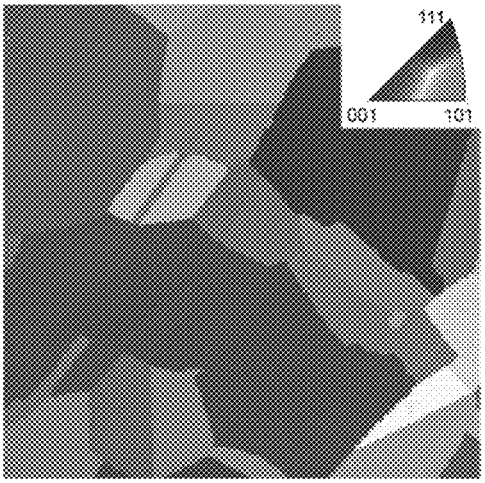
FIGS. 1A-1C show the microstructure of the AR steel.

In the following description, A ductile work-hardened nanostructured steel alloy with dynamically transformable nanotwins is set forth as a preferred example. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

In accordance with a first aspect of the present invention, a method of creating a ductile, work-hardened, dynamically transformable nanotwinned structure in an austenite steel alloy is provided. There are two basic principles for fabricating the steel alloy with nanotwinned, austenite/martensite nano-lamellar nanostructure, including (1) controlling the stability of the austenite to make sure that the steel alloy is primarily composed of an austenite phase after quenching; (2) adjusting the stacking fault energy of the austenite to obtain dynamically transformable twins during the forming process.

The method mainly includes the following steps:

- smelting high-purity raw materials to obtain an as-cast alloy ingot;
- homogenizing the as-cast alloy ingot to obtain a homogenized alloy ingot;
- cold-rolling the homogenized alloy ingot at room temperature to a reduction of 40-60%;
- recrystallizing the cold-rolled alloy ingot to eliminate any possible casting defects and form an as-recrystallized steel alloy having a single face-centered cubic structure with recrystallized grains; and
- cold-rolling the as-recrystallized austenite steel alloy with a reduction of 40-80% for forming a nanotwinned austenite structure and for forming martensite lamellae along nanotwin boundaries such that an austenite/martensite nano-lamellar structure is formed in the steel alloy during further straining.

In one embodiment, the dynamically transformable nanotwinned austenite/martensite structure provides twin boundaries as a platform for impeding dislocation and transforming the austenite partially into martensite to form a nano-laminated martensite/austenite dual-phase structure when the alloy is under a strain.

In one embodiment, the temperature of recrystallization annealing is higher than an austenitizing temperature, which may be between 1000-1200° C.

In one embodiment, the recrystallization annealing is substituted by a hot-roll or hot-forge treatment at a temperature higher than the austenitizing temperature.

In one embodiment, the high-purity raw materials comprise 22-26 wt. % of Ni, 0.8-2.5 wt. % of Al, 0.8-2.5 wt. % of Si, 0.2-0.6 wt. % of C and 66.2-68.4 wt. % of Fe. To ensure chemical homogeneity, all the samples were repeatedly melted at least 5 times before drop-casting into a rectangular copper mold with a thickness of 10 mm and a width of 12 mm. The ingot is homogenized at 1050-1100° C. for 2 hours followed by cold rolling at room temperature with a reduction of 60% to a thickness of 6 mm and then recrystallized at 1050-1100° C. for 2 hours. After being cold rolled at room temperature with a reduction of 75% to a thickness of 1.44 mm followed by annealing at 170° C. for 12 hours, the DT-NT steel sample exhibits a super high strength of 1.4 GPa, almost five times than as-recrystallized steel (289 MPa), while maintaining an unexcepted uniform elongation of 44%. This demonstrates that the formed alloy is both an ultrahigh strength alloy while maintaining high ductility.

In another embodiment, the high-purity raw materials comprise 22-25 wt. % of Ni, 0.8-3 wt. % of Si, 0.2-0.6 wt. % of C, and 71.4-77 wt. % of Fe. To ensure the chemical homogeneity, all the samples were repeatedly melted at least 5 times before drop-casting into a rectangular copper mold with a thickness of 10 mm and a width of 12 mm. The ingot is homogenized at 1050-1100° C. for 2 hours followed by cold rolling at room temperature with a reduction of 60% to a thickness of 6 mm and then recrystallized at 1050-1100° C. for 2 hours. After being cold rolled at room temperature with a reduction of 75% to a thickness of 1.44 mm followed by annealing at 170° C. for 12 hours, the DT-NT steel sample exhibits a yield strength of 1320 MPa, more than five times that of the recrystallized steel (257 MPa) and a uniform elongation of 45%.

By combining cold-rolling and low-temperature annealing, the DT-NT steel can be provided with a yield strength of more than 1.4 GPa and uniform elongation of 40%. The DT-NT steel outperforms most commercial high-strength steel. The exceptional strength-ductility synergy of the DT-NT steel means that it can offer higher safety, great potential in weight reduction and energy savings, and higher formability.

Such promoted martensite transformation, transforming a portion of the austenite into martensite, is rarely observed in severely deformed alloys. Extensive studies have reported that large pre-deformation could increase the stability of austenite and suppresses martensite transformation, well known as the mechanical stabilization of austenite. The reason for the stabilization is that high-density crystalline defects (dislocations and grain boundaries) induced by pre-deformation destroy the cohesive relationship between martensite and the parent austenite, suppressing martensite nucleation. Meanwhile, the hardening of austenite increases the transformation strains, elevating the energy needed for martensite nucleation. As an example, it is found that the start temperature ($M_S$) for martensite transformation in Fe-9% Mn alloy monotonously decreases with the increase in the cold-rolling reduction. In the present invention, it is also disclosed that the suppression of martensite transformation occurs in the dislocation region (non-nanotwinned region). The mechanical stabilization of austenite is one of the primary reasons for the strength-ductility trade-off in metastable alloys. However, in the present DT-NT steel alloys, the martensite transformation is substantially promoted in the nanotwins, which provides a strategy for enabling the great potential of the transformation induced plasticity (TRIP) effect in nanostructured alloys. As seen in FIG. 4, the martensite emanates from the nanotwins, forming the lamellar structure of martensite/austentite that creates the high strength while maintaining the high ductility.

In accordance with a second aspect of the present invention, a dynamically transformable nanotwinned austenite steel alloy is provided. Particularly, the steel alloy is prepared by the above method and has a dynamically transformable nanotwinned austenite structure that is able to be transformed from austenite to martensite partially to form a nano-laminated austenite/martensite dual-phase structure when the steel alloy is under a strain.

In one embodiment, the DT-NT steel is composed of 22-26 wt. % of Ni, 0.8-2.5 wt. % of Al, 0.8-2.5 wt. % of Si, 0.2-0.6 wt. % of C and 66.2-68.4 wt. % of Fe. In another embodiment, the steel alloy is composed of 22-25 wt. % of Ni, 0.8-3 wt. % of Si, 0.2-0.6 wt. % of C and 71.4-77 wt. % of Fe.

To realize industrialized production at a low cost, the chemical composition of the DT-NT steel is kept as simple as possible. It has only four or five elements including Ni, Al, Si, C and Fe. In the DT-NT steel, adding Ni, C, and Si effectively stabilize the austenite and decrease the martensite transformation start temperature. However, excessive Ni, Si, and C will make the austenite too stable and suppress the occurrence of deformation nanotwins and strain-induced martensite. The stacking fault energy is adjusted by the addition of Al and C. Specifically, the addition of Al increases the stacking fault energy while C decreases the stacking fault energy. Additionally, the addition of Al enhances oxidation resistance, decreases the grain-coarsening temperature, reduces the density and increases the strength-to-weight ratio. Further, adding Si increases the strength of austenite and enhances the resistance to oxidation and corrosion. However, both excessive Al and Si facilitate the formation of the brittle phase, decreasing the ductility, toughness and processability of the steel. The element C plays an important role in strengthening austenite and martensite. Yet, excessive C decreases the welding property.

Importantly, the alloys may be free of chromium, as is commonly used in stainless steel alloys. This reduces the cost of the steel alloy.

Figure 1B:
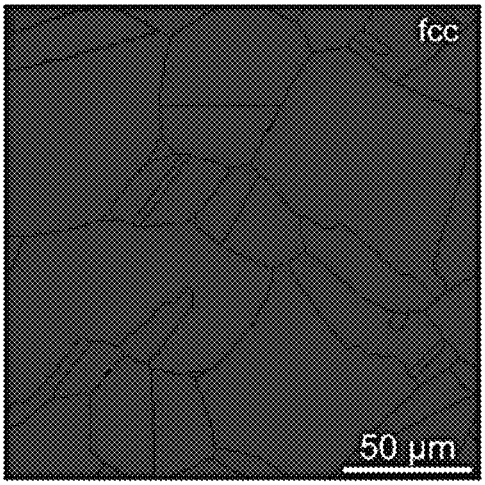
Figure 1C:
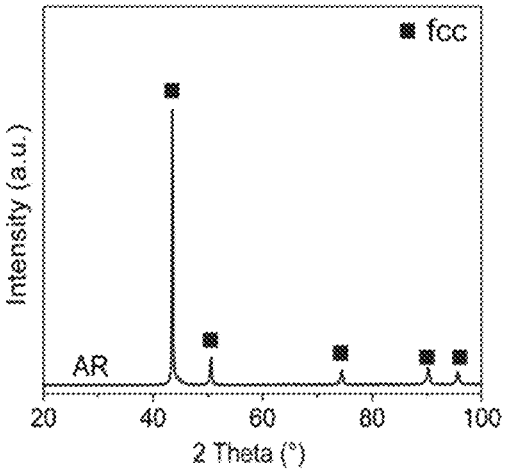

The nanotwinned austenite/martensite strengthening strategy is applied on an austenite steel (Fe-22% Ni-4% Al-4% Si-2% C, atomic percent). The Ni, Si, and C atoms are effective austenite stabilizers that suppress martensite transformation during quenching. Consequently, after the homogeneous annealing treatment and quenching, a single face-centered cubic (fcc) structure with recrystallized grains (70 μm average grain size) is obtained and donated henceforth as the as-recrystallized (AR) steel alloy. Referring to FIGS. 1A-1C, the electron backscatter diffraction orientation image, phase map, and X-ray pattern of the microstructure of the as-recrystallized (AR) steel alloy are demonstrated. By controllably cold-rolling at ambient temperature, the nanotwin structure is introduced into the AR alloy while maintaining the single fcc phase, fabricating the DT-NT steel. By leveraging the nanotwinned austenite/martensite strengthening, a simultaneous improvement in strength and ductility is also realized.

The as-recrystallized DT-NT steel exhibits a good strength-ductility synergy similar to the widely used commercial austenite steels. Moreover, after the forming process, the strength of the DT-NT steel is elevated by nearly 5 times from 250~290 MPa to 1.3-1.4 GPa without sacrificing ductility, which is never before observed in commercial steels. For many commercial high-strength steels, when the yield strength exceeds 1 GPa, the uniform elongation becomes limited, even less than 10%. Compared with the 304 and 316L stainless steels, the DT-NT steel is much safer, cheaper, and more processible, thus it will be highly competitive in the market. Moreover, the DT-NT steel could be fabricated by conventional heat treatments and forming techniques, enabling large-scale production at a low cost. On these grounds, the DT-NT steel is a potential candidate for replacing the current austenite steel that is widely used in automobiles, buildings, and aerospace.

In one embodiment, the DT-NT steel is an austenite/martensite structure with nano-laminated martensite/austenite dual-phase microstructure, and ausmartensite lamellae is forming along nanotwin boundaries such that an austenite/martensite nano-lamellar structure in the steel alloy is created; in another embodiment, the martensite phase being present in the DT-NT steel is in an amount between 7 and 30 volume percent.

In summary, the yield strength of the DT-NT steel far exceeds that of other steels (such as 304 stainless steel, dual-phase steels, martensite steels, and high manganese steel) with comparable uniform elongation, suggesting that the DT-NT steel is promising to increase the life of the final products and reduce the weight. The uniform elongation of the DT-NT steel is one order of magnitude larger than that of commercial steels (such as martensite steels) at the same strength level. This means the DT-NT steel is more formable and can be manufactured into complex shapes. The production routes of the DT-NT steels are based on combinations of conventional processes. Therefore, the production of the DT-NT steel can be industrialized.

EXAMPLES

Example 1

Figure 2A:
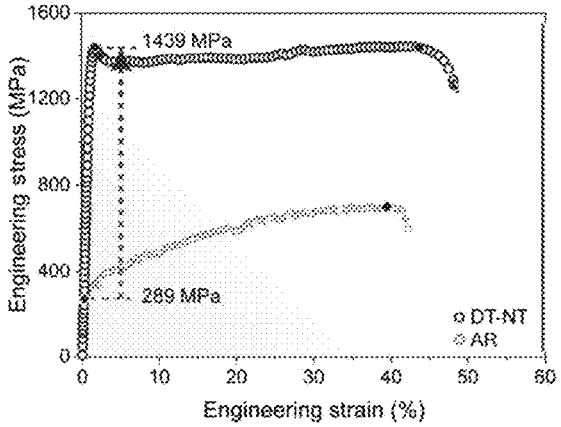
FIGS. 2A-2D demonstrate the mechanical properties of the DT-NT steel alloy.
Figure 2B:
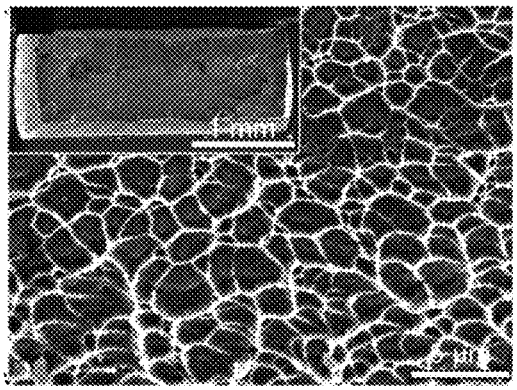
Figure 2C:
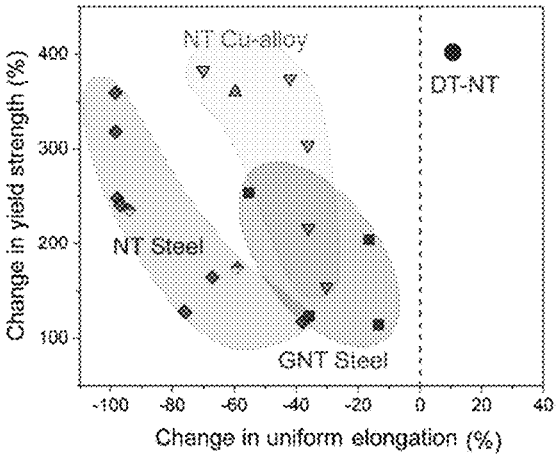
Figure 2D:
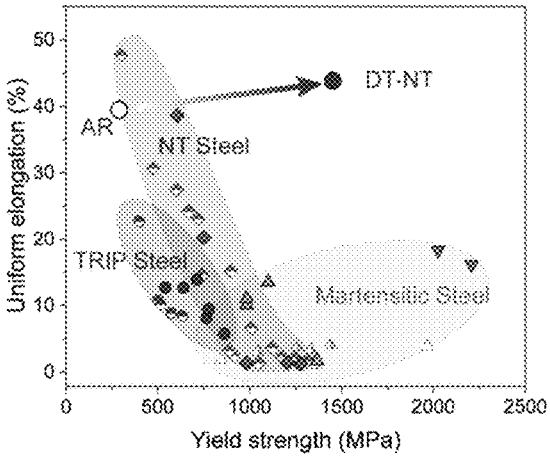

Referring to FIGS. 2A-2D, the mechanical properties of DT-NT steel are further evaluated. As shown in FIG. 2A, by comparing the engineering stress-strain curves of the as-recrystallized (AR) and DT-NT steels, it is observed that the nanotwinned austenite/martensite alloy has a yield strength ($\sigma_y$) of 1439 MPa, almost five times than AR steel (289 MPa). Importantly, the nanotwinned austenite/martensite alloy has an exceptional uniform ductility (44%), which is even slightly superior than CG samples (39.8%). As shown in FIG. 2B, the fracture surface of the DT-NT steel is characterized by numerous dimples, indicating a ductile fracture. As shown in FIG. 2C, for the NT alloys, such as NT Cu, 316L and 304 stainless steel and the gradient nanotwinned (GNT) steels, dramatic losses in ductility always come with the multiplication of $\sigma_y$. Usually, when the $\sigma_y$ of nanotwinned alloys reaches gigapascal, the uniform elongation is completely diminished. The exceptional strength-ductility synergy of the DT-NT steel outperforms many high-strength steels, such as the nanotwin strengthening (NT) steels, martensite steels, and transformation-induced plasticity (TRIP) steels. As shown in FIG. 2D, the uniform elongation of the DT-NT steel is one order of magnitude larger than martensite steel at the same strength level. Meanwhile, the yield strength of the DT-NT steel far exceeds other steels with comparable uniform elongation. The DT-NT steel successfully escapes from the strength-ductility trade-off, contradicting the conventional knowledge that cold rolling produces higher strength but severely sacrifices ductility.

Example 2

Figure 3A:
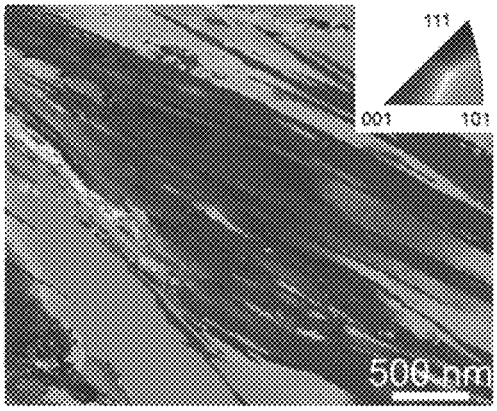
FIGS. 3A-3H show the microstructure of the DT-NT steel before the tensile test.
Figure 3B:
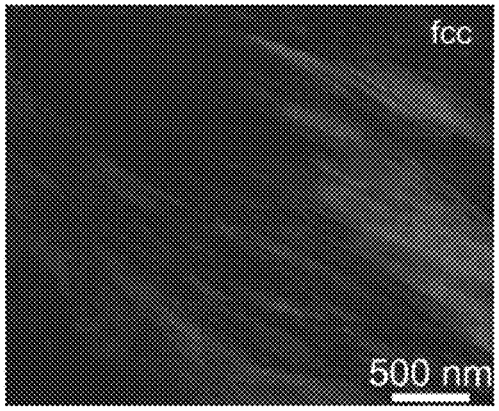

To clarify the originations of the ultrahigh strength, microstructural investigations of the DT-NT steel are conducted. The DT-NT steel exhibits a single fcc structure consisting of a high density of twin bundles in electron backscatter diffraction orientation images (as shown in FIGS. 3A-3B).

Figure 3C:
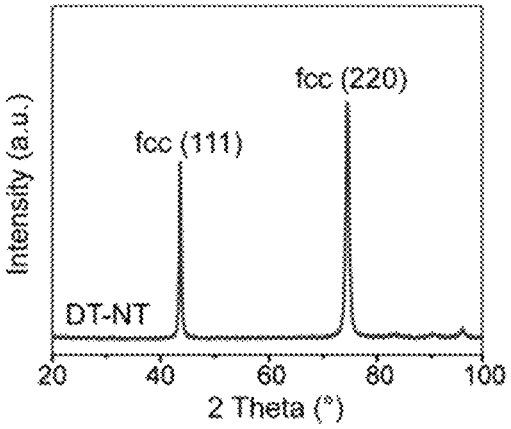

The phase identifications are examined by using a Rigaku X-ray diffraction (XRD) instrument and Cu-$K_\alpha$ radiation with a monochromator. As shown in FIG. 3C, the XRD pattern of the DT-NT steel confirms that no martensite phase occurred during the cold-rolling process attributed to the adiabatic heating effect.

Figure 3D:
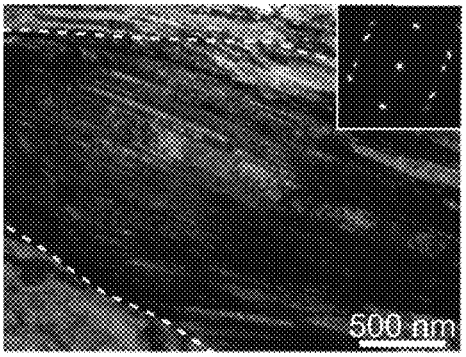
Figure 3E:
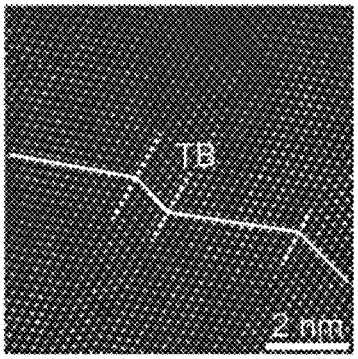
Figure 3F:
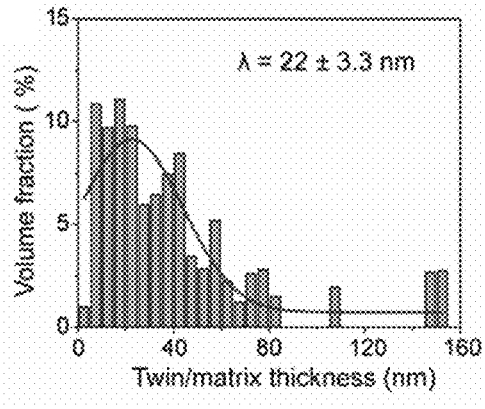

Further, transmission electron microscopy (TEM) is carried out to characterize the microstructure evolution during tensile tests. TEM observations are performed in a JEOL 2100F operated at 200 kV and a double aberration-corrected TEM (Titan Cubed Themis G2300) operated at 300 kV. The samples for TEM characterization are prepared by mechanical polishing down to a thickness of 50 μm, punched into Φ3 mm disks, and subsequently thinned by an ion-milling method. As shown in FIG. 3D, the further characterizations by TEM reveal that the DT-NT steel is composed of two types of substructures: rhombic twin bundles (outlined by the dashed line, hereafter referred to as nanotwinned austenite/martensite grains) are embedded in a severely deformed matrix consisting of high-density dislocations ($2.374\times10^{15}$ $m^{-2}$). The high-resolution TEM observation (FIG. 3E) confirms that the twin/matrix lamella thickness is at the nanoscale, ranging from 3 nm to 150 nm, with an average value of 22±3.3 nm (FIG. 3F). Statistical measurements by TEM showed that the nanotwins constitute 66% in volume.

Figure 3G:
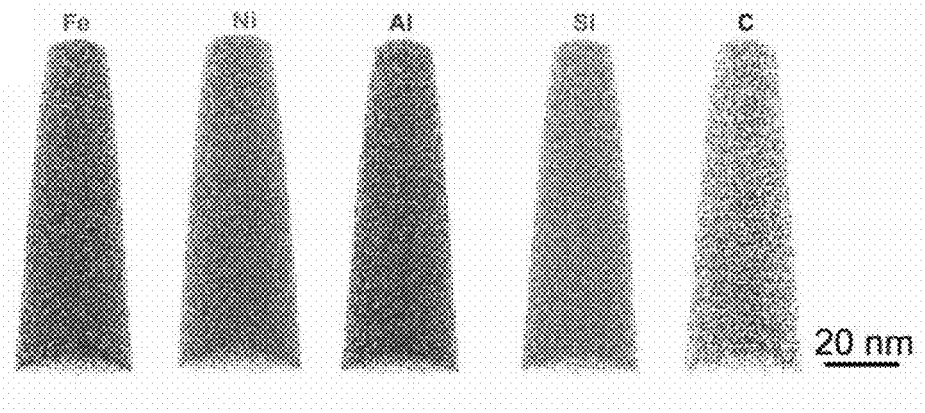
Figure 3H:
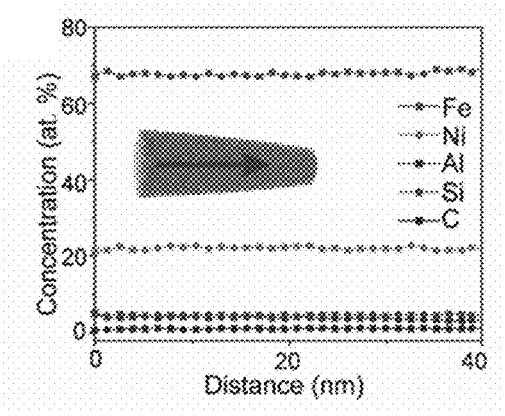

Furthermore, the 3D atom probe tomography (APT) measurements are performed to characterize the elemental distribution. The APT measurements are performed in a local electrode atom probe (CAMEACA LEAP 5000 XR). The nanotwinned austenite/martensite specimens are analyzed at 70 k in voltage mode, at a pulse repetition rate of 200 kHz, a pulse fraction of 20%, and an evaporation detection rate of 0.2% atom per pulse. Needle-shaped specimens required for APT are fabricated by lift-outs and annular milled in dual-beam focused ion beam (FIB) instrument (FEI Scios). As shown in FIGS. 3G-3H, the chemical composition results of the DT-NT steel show that the elements are distributed uniformly without forming precipitates such as carbides.

Example 3

The nano-spaced twin boundaries effectively impede dislocations, engendering higher stress for dislocation activations, which is the primary contributor to the high strength. Therefore, the individual strengthening of the contribution of dislocation and nanotwins in the DT-NT steel is further investigated.

According to the Taylor hardening law and mixing rule, the yield stress contributed by the nanotwinned and dislocation strengthening is estimated to be 898 and 303 MPa, respectively. The strength of nanotwins reaches 1.36 GPa but is still lower than the value calculated by the Hall-Petch relationship (1.8 GPa), because the plastic deformation of nanotwins introduced by plastic deformation is commonly dominated by the collaboration of dislocation in soft mode, hard mode I, and II.

Example 4

The uniqueness of the DT-NT steel is that it not only strengthens the alloy like the NT but also acts as a ductilizing source by enhancing work-hardening capabilities. It is important to insight into and characterize the plastic deformation micro-mechanisms of the DT-NT steel. Briefly, to test the uniaxial tensile properties, dog-bone-shaped specimens with a gauge length of 12.5 mm and a cross-section of $3.2\times1.4$ $mm^2$ are fabricated using wire electrical discharge machining. The loading direction of the tensile samples is aligned along the rolling direction. All tensile samples are grounded with fine SiC paper up to 2000 #. The tensile tests are carried out at ambient temperature in a Material Testing System (MTS, Alliance RT30) tension machine with a strain rate of $2\times10^{-4}$ $s^{-1}$. Three tests are performed for each sample to ensure data reproducibility.

Figure 4A:
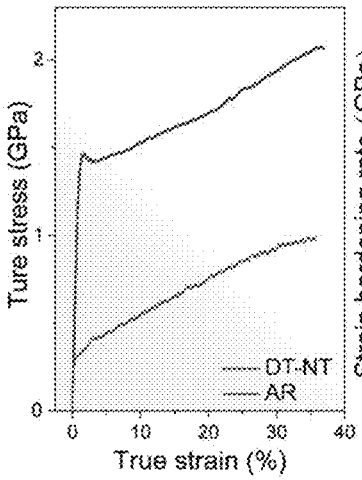
FIGS. 4A-4J exhibit plastic deformation micro-mechanisms of the DT-NT steel.
Figure 4B:
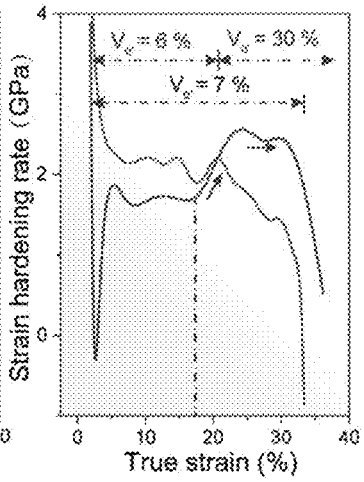
Figure 5A:
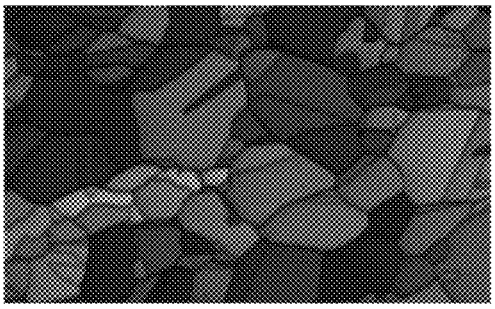
FIGS. 5A-5F depict the EBSD, TEM, and XRD figures of AR alloy showing microstructure evolution during tension.
Figure 5B:
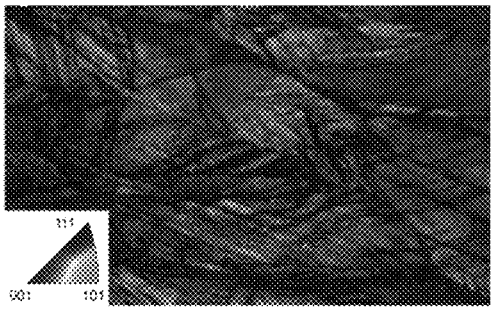
Figure 5C:
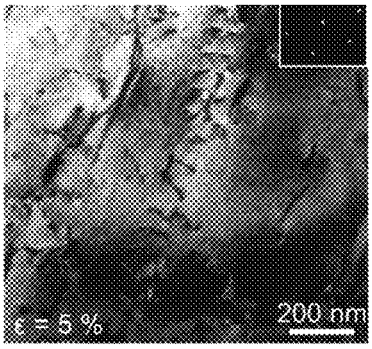
Figure 5D:
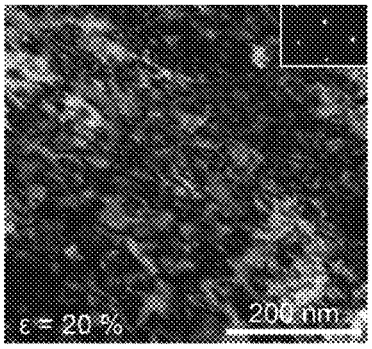
Figure 5E:
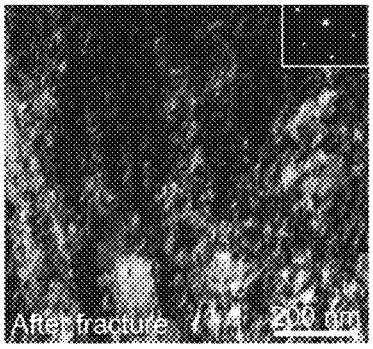
Figure 5F:
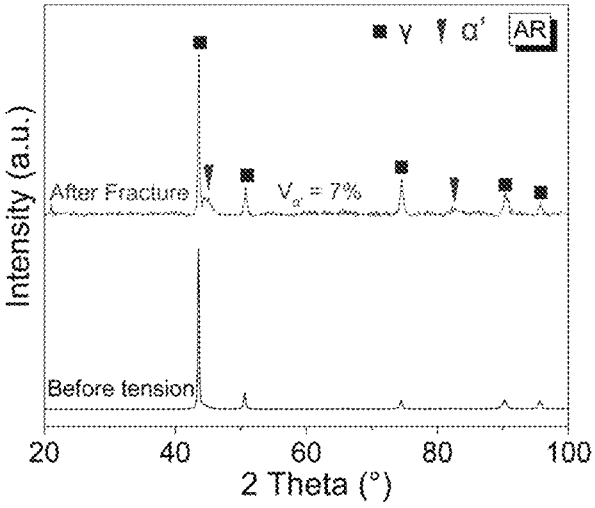
Figure 6A:
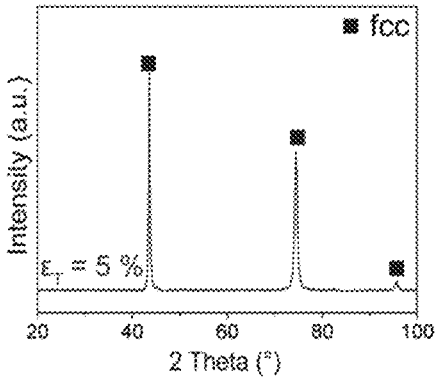
FIGS. 6A-6C show the deformation mechanism of the DT-NT steel at strain at 5%.
Figure 6B:
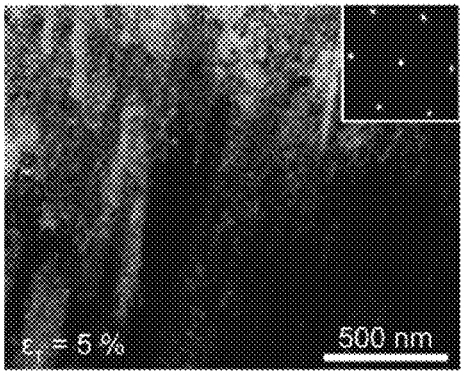
Figure 6C:
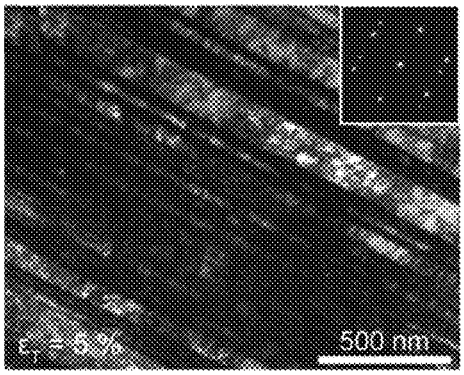

The uniqueness of the nanotwinned austenite/martensite is that it could not only strengthen the alloy like the NT but also act as a ductilizing source by enhancing work-hardening capabilities. As shown in FIGS. 4A-4B, different from the AR alloy with a continuously decreased work-hardening capability, the DT-NT steel exhibit an obvious hardening stage, which enables doubling the true tensile stress up to 2.1 GPa without sacrificing ductility. The linearly decreased work-hardening rates with the increase in the true strain is a typical feature of alloys whose plastic deformation is dominated by dislocations, which is induced by the exhausting capability of dislocation accumulation. The combined characterization by EBSD (FIGS. 5A-5B), TEM (FIGS. 5C-5E), and XRD (FIG. 5F) confirm the dislocation-dominated deformation mechanism of the AR alloy. As shown in FIGS. 5A-5B, they are inverse pole figures of AR alloy before tension and after fracture, respectively. The density of slip bands increases with the strain increasing, and a low density of martensite is observed in the AR alloy after a fracture. Referring to FIG. 5C-5E, the typical bright-field TEM images show the deformation mechanics of AR alloy at the strain of 5%, 20%, and after a fracture. It indicates that the dislocation density increases with the increasing strain, and with the inserted selected area electron diffraction (SAED) patterns, it is clear that no martensite transformation occurred in these dislocation structures. As shown in FIG. 5F, there are only small amounts of martensite (7 vol. %) identified in the post-fracture AR samples, which is not sufficient to improve the work-hardening capability.

In contrast, a multistage work-hardening behavior with an obvious hardening stage is observed in the DT-NT steel. During tension, the pre-existing dislocations are first to be activated to sustain the tensile strain. The depinning of dislocations from the interstitial solution atoms results in a dramatic drop in the work-hardening rate at the strain below 2%, known as discontinuous yielding. As shown in FIGS. 6A-6D, at a strain below 17% (for example, 5%), the XRD pattern (FIG. 6A) and the typical bright-field TEM images (FIGS. 6B-6C) showing that the deformation of DT-NT steel is dominated by dislocation activities and few martensite regions occurred to sustain tensile strains. The pronounced collapse and dynamic recovery of pre-existing dislocations result in a positive but lower work-hardening rate compared with the AR alloy. However, with further deformation (at the strain ≥17%), the work-hardening rate of the DT-NT steel increased significantly and exceeds that of the AR alloy at 20%, showing a distinct work-hardening stage. Moreover, the DT-NT steel keeps a high work-hardening rate (approximately 2.5 GPa) until the strain of 30%. Such work-hardening behavior is observed neither in NT alloys, nanograined alloys, nor alloys after deformation processing which is usually characterized by a steep decrease in work-hardening. Undoubtedly, the key reason for the superior ductility in the conventional NT alloy is the pronounced work-hardening at the strain larger than 17%.

Figure 7:
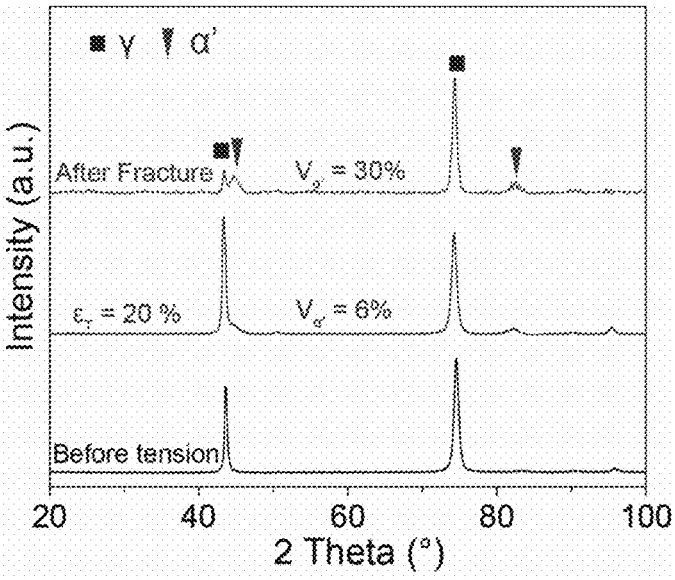
FIG. 7 shows the XRD patterns of the DT-NT steel under different engineering strains.
Figure 8A:
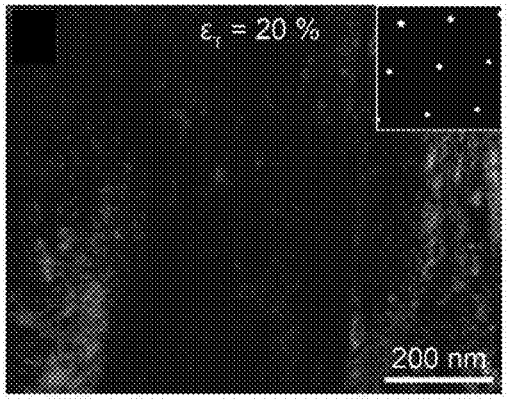
FIGS. 8A-8B exhibit the deformation mechanism of the dislocation regions with an inserted image showing that no martensite transformation occurred in the dislocation regions.
Figure 8B:
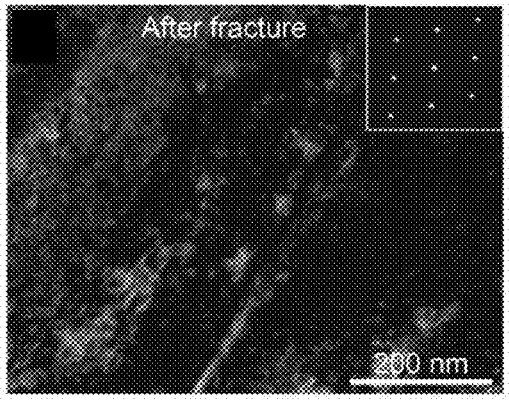

To decipher the microstructural origin of the enhanced work-hardening rate in the DT-NT steel at the strain large than 17%, a series of systematic microstructural investigations on the dynamic evolution of deformation microstructure at different strains are conducted. It is shown that the martensite transformation occurred as the true strain increased higher than 17%. The volume fraction of martensite increased from 6 vol. % at the strain of 20% to 30 vol. % after fracture (calculated using XRD patterns shown in FIG. 7). The enhanced martensite transformation certainly accounts for the enhanced work-hardening rate. Moreover, further microstructure investigation by EBSD (FIGS. 4C-4F) and TEM (FIGS. 4G-4J) reveals that the deformation-induced martensite transformation occurs predominantly in the NT bundles and is hardly observed in the dislocation regions (FIGS. 8A-8B). The statistic measurements by EBSD show that the volume fraction of martensite within nanotwins increases from 9.4 vol. % at the true strain of 20% to 54.3 vol. % after the fracture, confirming that nearly all martensite transformation occurred in nanotwinned grains.

Figure 4C:
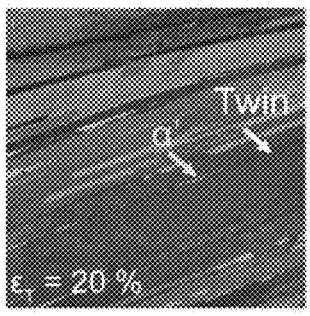
Figure 4D:
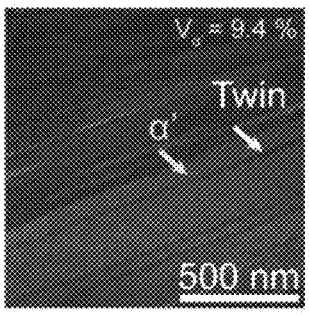
Figure 4E:
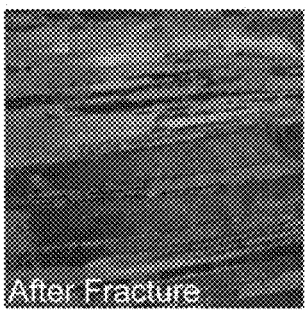
Figure 4F:
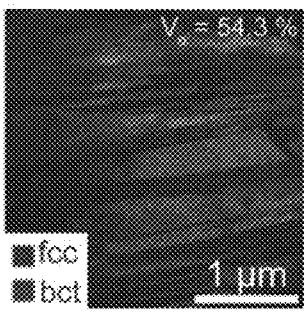
Figure 4G:
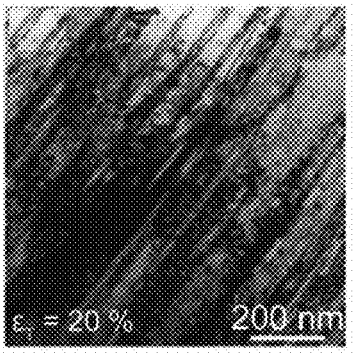
Figure 4H:
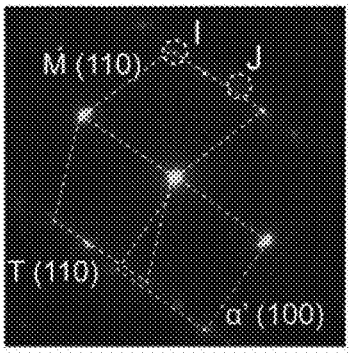
Figure 4I:
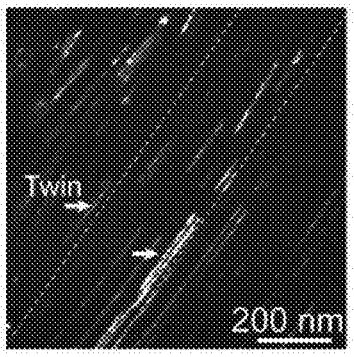
Figure 4J:
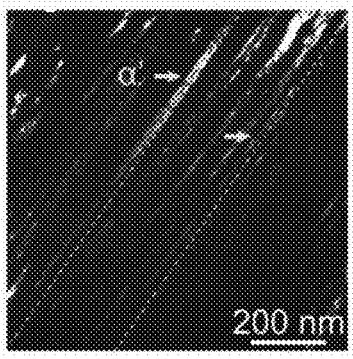

As shown in FIGS. 4C-4D, in the nanotwinned regions, the martensite is lamellar and aligned parallel to the twin lamellae. The selected area electron diffraction (SAED) (FIG. 4H) of the nanotwinned region (FIGS. 4G) manifested that the double Nishiyama-Wasserman relationship ($\{111\}_{\gamma_T}\|\{111\}_{\gamma_M}\|\{010\}_{\alpha'}$; $\langle\bar{1}01\rangle_{\gamma_T}\|\langle\bar{1}01\rangle_{\gamma_M}\|\langle 0\bar{1}0\rangle_{\alpha'}$) between martensite and austenite, indicating that the habitat plane of martensite transformation is the twin plane. In dark-field TEM mode, the twin/matrix and martensite are distinguished, as shown in FIG. 4I and FIG. 4G, respectively. The images show that the nanoscale twin lamellae become discontinuous due to the martensite transformation (FIGS. 4I-4J). With the increase in strains, the lamellar martensite dynamically grows along the twin/matrix lamellae, transforming the austenite nanotwins into the laminated austenite/martensite dual-phase structure (FIG. 4E-4F).

Figure 9:
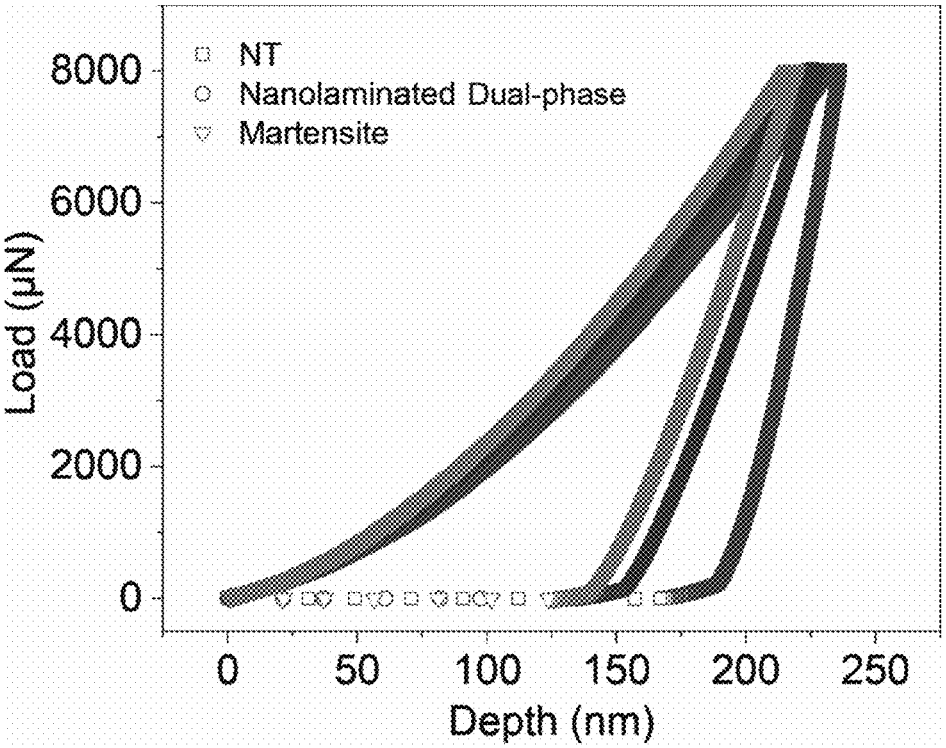
FIG. 9 demonstrates the nanohardness of the nanotwins (NT), nanolaminated dual-phase structure and martensite.

The dynamic-transformable nanotwins serve as a ductilizing source by providing adequate work-hardening capabilities. Confined by the parent nanotwins, the martensite also exhibits a nanoscale thickness, leading to the formation of a nanolaminated austenite/martensite dual-phase structure. As shown in FIG. 9, the newborn nanolaminate dual-phase structure exhibits a nanohardness of 7.5±0.3, (the nanohardness of the martensite reaches up to 8.1±0.46 GPa), much higher than the parent nanotwins (with a nanohardeness of 5.6±0.4 GPa). Consequently, the continuous martensite transformation in the nanotwins at large strain can dynamically strengthen alloys and suppress strain localization, contributing to exceptional ductility. Such deformation mechanism of the DT-NT steel is quite different from conventional NT alloys. In conventional NT alloys, the twin boundaries are stable against plastic deformation without any phase transformation. However, the capability for dislocation multiplication is quickly exhausted at increasing strain, and localized deformation in terms of shear bands and detwinning comes to dominate the plastic deformation. The severe localized deformation deteriorates the strengthening effect of nanotwins and also leads to early necking.

Example 5

Figure 10A:
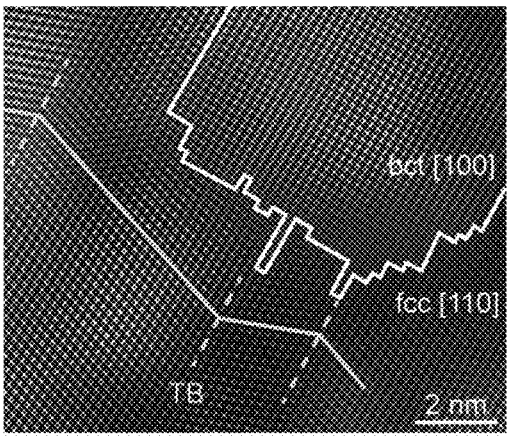
FIGS. 10A-10C depict the mechanism of martensite transformation in nanotwins.
Figure 10B:
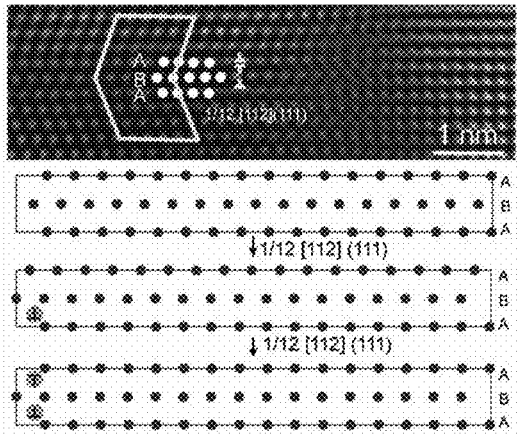
Figure 10C:
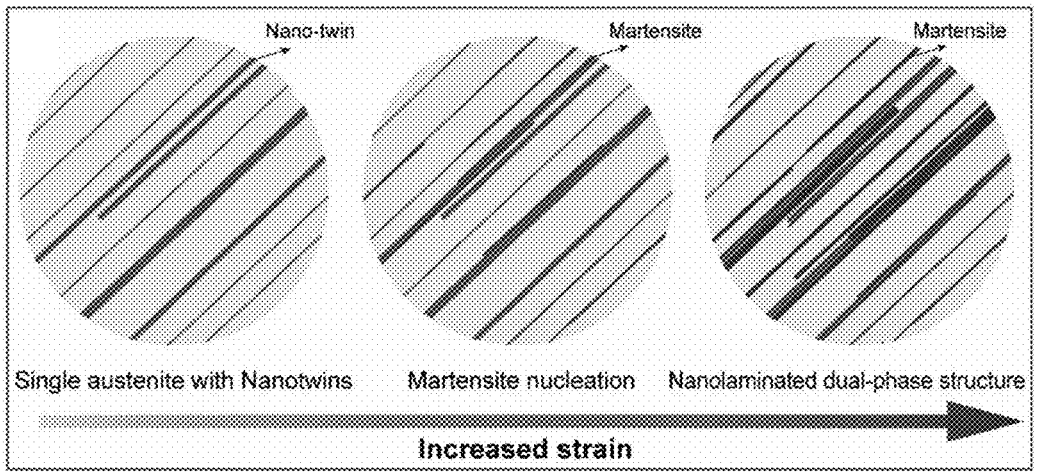

To unveil the underlying mechanism for martensite transformation in nanotwins, combined theoretical and experimental studies were performed The high-resolution transmission electron microscopy (HRTEM) observation demonstrates that twin boundaries provide nucleation sites for the martensite transformation (FIG. 10A). The transition from face-centered cubic structure austenite to body-centered tetragonal structure (bct)-α' martensite can be accomplished by two-step Shockley partial dislocation (⅙(112))) movements. In the first step, Shockley partial dislocations glide on every second $(111)_\gamma$ plane to form a hexagonal close packing (hcp)-ε phase. Then, half-Shockley partial dislocation dipoles slip on every $(0001)_\varepsilon$ plane in the hcp phase, transforming the hcp-ε phase to the bct-α' martensite. However, as shown in FIG. 10B, assisted by the twin boundaries, the martensite transformation can be executed by only one step: half-Shockley partial dislocation (⅓(112)) dipoles gliding on the twin plane accompanied by atom shuffling transforming the twin plane into a martensite nucleus (FIG. 10C). Consequently, twin boundaries are preferential sites for the martensite nucleation. Moreover, there are numerous kink steps on the deformation-induced twin boundaries, which promote the nucleation of partial dislocations, accelerating the martensite transformation.

In summary, the nanotwinned austenite/martensite strengthening overcomes the strength-ductility trade-off of metallic materials by utilizing the bifunctional twin boundaries: twin boundaries only impede dislocation to elevate strength but also promote the martensite transformation to enable the TRIP effect and improve ductility. The present invention shows the effectiveness of nanotwins in promoting the martensite transformation in severely deformed austenite steels by serving as a preferential site for nucleation, suggesting a new pathway to optimize the ductility of nanocrystalline alloys. This easy and efficient strengthening strategy is expected to be readily applicable to other metastable alloys.

The foregoing description of the present invention has been provided for illustration and description. It is not intended to be exhaustive or to limit the invention to the precise forms disclosed. Many modifications and variations will be apparent to the practitioner skilled in the art.

The embodiments were chosen and described to best explain the principles of the invention and its practical application, thereby enabling others skilled in the art to understand the invention for various embodiments and with various modifications that are suited to the particular use contemplated.

As used herein and not otherwise defined, the terms "substantially," "substantial," "approximately" and "about" are used to describe and account for small variations. When used in conjunction with an event or circumstance, the terms can encompass instances in which the event or circumstance occurs precisely as well as instances in which the event or circumstance occurs to a close approximation. For example, when used in conjunction with a numerical value, the terms can encompass a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

The invention claimed is:

1. A ductile chromium-free work-hardened nanostructured Fe-Ni-Al-Si-C steel alloy comprising:

a nano-laminated martensite/austentite dual-phase nanostructure, the martensite phase extending from nanotwinned regions and being present in an amount from 7 to 30 volume percent of the nanostructure, the martensite phase formed as martensite lamellae alternating with austentite lamellae; wherein the lamella thickness ranges from approximately 3 nm to approximately 150 nm.

2. The steel alloy of claim 1, wherein the ductile work-hardened Fe—Ni—Al—Si—C steel alloy has a yield strength of at least approximately 1.4 GPa with an elongation of at least approximately 40 percent.

3. The steel alloy of claim 1, wherein the ductile work-hardened Fe—Ni—Al—Si—C steel alloy is composed of 22-26 wt. % of Ni, 0.8-2.5 wt. % of Al, 0.8-2.5 wt. % of Si, 0.2-0.6 wt. % of C and 66.2-68.4 wt. % of Fe.

4. The steel alloy of claim 1, wherein the ductile work-hardened Fe—Ni—Al—Si—C steel alloy is composed of 22-25 wt. % of Ni, 0.8-3 wt. % of Si, 0.2-0.6 wt. % of C and 71.4-77 wt. % of Fe.

5. A safety component composed on an automobile, wherein the safety component is made of the steel alloy of claim 1.

6. The safety component of claim 5, wherein the safety component comprises front side members, floor side reinforcement, still inner, rear side member, B-pillar reinforcement, roof bow, and A-frame reinforcement.

7. A building material, wherein the building material is made of the steel alloy of claim 1.

8. The building material of claim 7, wherein the building material comprises a cable, a steel beam, and a scaffold.

9. An aircraft material, wherein the building material is made of the steel alloy of claim 1.

10. A method of creating the ductile chromium-free work-hardened nanostructured Fe—Ni—Al—Si—C steel alloy of claim 7, comprising:

smelting raw materials to obtain an as-cast steel alloy ingot;

homogenizing the as-cast alloy ingot to obtain a homogenized austentite steel alloy ingot;

cold-rolling the homogenized austentite steel alloy ingot at room temperature to a reduction of 40-60%;

recrystallizing the cold-rolled austentite steel alloy ingot to eliminate casting defects and form an as-recrystallized austentite steel alloy having single face-centered cubic structure with recrystallized grains; and cold-rolling the as-recrystallized austentite steel alloy with a reduction of 40-80% for forming a nanotwinned austenite structure and for forming martensite lamellae along nanotwin boundaries such that an austenite/martensite nano-lamellar structure in the steel alloy, the martensite phase being present in an amount between 7 and 30 volume percent.

11. The method of claim 10, further comprising annealing to facilitate dislocation recovery and relieve stress.

12. The method of claim 11, wherein the temperature of the annealing is higher than an austenitizing temperature, wherein the austenitizing temperature is between 140-200° C.

13. The method of claim 12, further comprising a hot-roll or hot-forge treatment at a temperature higher than the austenitizing temperature.

14. The method of claim 10, the raw materials comprise 22-26 wt. % of Ni, 0.8-2.5 wt. % of Al, 0.8-2.5 wt. % of Si, 0.2-0.6 wt. % of C and 66.2-68.4 wt. % of Fe.

15. The method of claim 10, the raw materials comprise 22-25 wt. % of Ni, 0.8-3 wt. % of Si, 0.2-0.6 wt. % of C and 71.4-77 wt. % of Fe.

* * * * *